US008926275B2

(12) United States Patent
Badafem et al.

(10) Patent No.: US 8,926,275 B2
(45) Date of Patent: Jan. 6, 2015

(54) CENTRIFUGAL PUMP

(75) Inventors: Awade Badafem, Shenzhen (CN); Min Li, Shenzhen (CN)

(73) Assignee: Johnson Electric S.A., Murten (CH)

( * ) Notice: Subject to any disclaimer, the term of this patent is extended or adjusted under 35 U.S.C. 154(b) by 538 days.

(21) Appl. No.: 13/293,559

(22) Filed: Nov. 10, 2011

(65) Prior Publication Data

US 2012/0114473 A1 May 10, 2012

(30) Foreign Application Priority Data

Nov. 10, 2010 (CN) ..... 2010 1 0539475

(51) Int. Cl.
*F04D 29/50* (2006.01)
*F04D 29/42* (2006.01)

(52) U.S. Cl.
CPC ..... *F04D 29/426* (2013.01); *Y10S 415/911* (2013.01)
USPC ..... 415/206; 415/148; 415/126; 415/211.2; 415/911

(58) Field of Classification Search
CPC ..... F04D 29/46; F04D 29/50; F04D 29/506
USPC ..... 415/126, 148, 206, 211.2, 911; 417/423.14
See application file for complete search history.

(56) References Cited

U.S. PATENT DOCUMENTS

| | | | | | |
|---|---|---|---|---|---|
| 4,600,361 | A * | 7/1986 | Bianco | 415/146 |
| 4,728,260 | A * | 3/1988 | Ishii | 415/151 |
| 4,869,076 | A * | 9/1989 | Sakai et al. | 62/347 |
| 4,874,298 | A * | 10/1989 | Mainardi et al. | 417/315 |
| 5,967,744 | A * | 10/1999 | Danner | 415/146 |
| 5,984,644 | A * | 11/1999 | Yu et al. | 417/302 |
| 6,923,617 | B2 * | 8/2005 | Elexpuru | 415/127 |
| 7,100,623 | B2 * | 9/2006 | Assmann et al. | 134/184 |

FOREIGN PATENT DOCUMENTS

| | | | |
|---|---|---|---|
| JP | 11113828 | A | 4/1999 |
| KR | 20070059433 | A | 6/2007 |
| KR | 20090071275 | A | 7/2009 |

* cited by examiner

*Primary Examiner* — Ninh H Nguyen
(74) *Attorney, Agent, or Firm* — Muncy, Geissler, Olds & Lowe, P.C.

(57) ABSTRACT

A centrifugal pump includes an electric motor, an impeller driven by the motor and a pump housing having an impeller chamber, an inlet in communication with the impeller chamber via an opening, and first and second outlets in communication with the impeller chamber. The impeller chamber has an interference structure which forms first and second flow channels in communication with the first and second outlets. The interference structure directs the fluid in the impeller chamber to flow through the first outlet via the first flow channel when the impeller rotates in a first direction or to flow through the second outlet via the second flow channel when the impeller rotates in the opposite direction.

18 Claims, 7 Drawing Sheets

CENTRIFUGAL PUMP

CROSS REFERENCE TO RELATED APPLICATIONS

This non-provisional patent application claims priority under 35 U.S.C. §119(a) from Patent Application No. 201010539475.X filed in The People's Republic of China on Nov. 10, 2010.

FIELD OF THE INVENTION

This invention relates to a centrifugal pump and in particular, to a centrifugal pump with two outlets.

BACKGROUND OF THE INVENTION

Korean Patent Application KR20090071275A discloses a drum type washing machine which includes a tub for washing clothes, a water supply pipe, a circulating pipe, a transfer pipe, a pump and a drain pipe. The water supply pipe is connected to the tub to supply water to the tub. The transfer pipe is connected to the tub to remove water from the tub. The pump is connected to the transfer pipe. The drain pipe is connected to the pump to discharge the water to a drain. The circulating pipe is connected to the pump to circulate the water back to the tub. A circulating valve and a drain valve are respectively arranged in the circulating pipe and the drain pipe. The pump is shared by the circulating pipe and the drain pipe but requires two valves to move the water in the correct direction.

The present invention aims to provide a centrifugal pump which is particularly suitable for the above application.

SUMMARY OF THE INVENTION

Accordingly, in one aspect thereof, the present invention provides a centrifugal pump comprising: an electric motor, an impeller driven by the motor; and a pump housing, wherein the pump housing has an impeller chamber, an inlet in communication with the impeller chamber via an opening, a first outlet and a second outlet, the first outlet and the second outlet being in communication with the impeller chamber at all times; an interference structure is arranged within the impeller chamber and forms a first flow channel in communication with the first outlet and a second flow channel in communication with the second outlet; and the interference structure is configured to direct fluid in the impeller chamber to flow through the first outlet via the first flow channel when the impeller rotates in a first direction and to direct fluid in the impeller chamber to flow through the second outlet via the second flow channel when the impeller rotates in a second direction.

Preferably, the pump housing comprises a top wall and a side wall, the first outlet and the second outlet outwardly extend from the side wall and are arranged at one side of the impeller.

Preferably, the interference structure comprises a first interference plate which is arranged at the same side of the impeller as the first outlet and the second outlet and partially surrounds the impeller.

Preferably, the interference structure further comprises a second interference plate and a third interference plate which extend to the side wall from respective circumferential ends of the first interference plate, the second interference plate forming the first flow channel with the side wall and the third interference plate forming the second flow channel with the side wall.

Preferably, the first interference plate has at least one reflux notch or hole formed at one end near the second interference plate, and the third interference plate has at least one reflux notch or hole formed near the first interference plate.

Preferably, the first interference plate is concentric with the impeller.

Preferably, the first outlet is wider than the second outlet, the distance between the first interference plate and the opening between the inlet and the impeller chamber gradually increasing from the second flow channel to the first flow channel.

Preferably, the first outlet is wider than the second outlet and the interference structure further comprises an interference part formed in the first flow channel for impeding flow of the fluid towards the first outlet when the impeller rotates in the second direction.

Preferably, the first outlet is wider than the second outlet, the center of the opening between the inlet and the impeller chamber is nearer to the center of the second flow channel relative to the center of the first flow channel or is arranged at one side of the center of the impeller nearer to the second flow channel relative to the first flow channel.

Preferably, the interference structure further comprises a fourth interference plate partially surrounding the impeller at the side of the impeller remote from the first interference plate.

Preferably, the fourth interference plate has two end portions extending to the side wall, one of the end portions forming an entrance of the first flow channel with the second interference plate and the other one forming an entrance of the second flow channel with the third interference plate.

According to a second aspect, the present invention provides a centrifugal pump comprising: an electric motor; an impeller driven by the motor; a valve; and a pump housing, wherein: the pump housing has having an impeller chamber, an inlet in communication with the impeller chamber, a first outlet and a second outlet, a first outlet chamber formed between the first outlet and the impeller chamber and a second outlet chamber formed between the second outlet and the impeller chamber; the first outlet chamber is in communication with the first outlet and the second outlet chamber is in communication with the second outlet; a first opening is formed between the first output chamber and the impeller chamber and a second opening is formed between the second output chamber and the impeller chamber; and the valve is driven by fluid pressure to close the second opening when the impeller rotates in a first direction whereby the fluid in the impeller chamber flows through the first outlet via the first opening and the first outlet chamber and to close the first opening when the impeller rotates in a second direction whereby the fluid in the impeller chamber flows through the second outlet via the second opening and the second outlet chamber.

Preferably, the valve comprises a first blocking member which is arranged in the first outlet chamber and a second blocking member which is fixedly linked to the first blocking member and is arranged in the second outlet chamber.

Preferably, a partition wall with a third opening is arranged between the first outlet chamber and the second chamber, and the first blocking member and the second blocking member are configured to close the third opening and the second opening when the impeller rotates in the first direction and to close the first opening and the third opening when the impeller rotates in the second direction.

Alternatively, a partition wall without an opening is arranged between the first outlet chamber and the second chamber, and two recesses for receiving the blocking members are formed in respective side of the partition wall.

Preferably, the impeller chamber has an interference structure arranged therein which forms a first flow channel in communication with the first outlet chamber and a second flow channel in communication with the second outlet chamber.

According to another aspect, the present invention also provides a centrifugal pump comprising: a first electric motor; an impeller driven by the first electric motor; and a pump housing having an impeller chamber, an inlet, a first outlet and a second outlet; a second electric motor; and a valve driven by the second electric motor to alternately communicate the first outlet and the second outlet with the impeller chamber.

Preferably, the pump housing further comprises: an outlet chamber formed between the impeller chamber and the first and the second outlets, the outlet chamber being in communication with the first and second outlets; a first opening opposing the first outlet and a second opening opposing the second outlet are formed between the outlet chamber and the impeller chamber; and the valve is rotatably mounted in the outlet chamber and has a first through hole and a second through hole not in communication with the first through hole, formed at positions corresponding to the first opening and the second opening and arranged to selectively connect the first opening with the first outlet and the second opening with the second outlet, such that the impeller chamber is able to be alternatively in communication with the first outlet via the first through hole and in communication with the second outlet via the second through hole.

Preferably, a resilient sealing member is arranged between the valve and an inner surface of the outlet chamber for preventing fluid leakage between the first outlet and the second outlet.

According to a further aspect, the present invention also provides a domestic appliance incorporating a centrifugal pump having two outlets as described above.

BRIEF DESCRIPTION OF THE DRAWINGS

Preferred embodiments of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
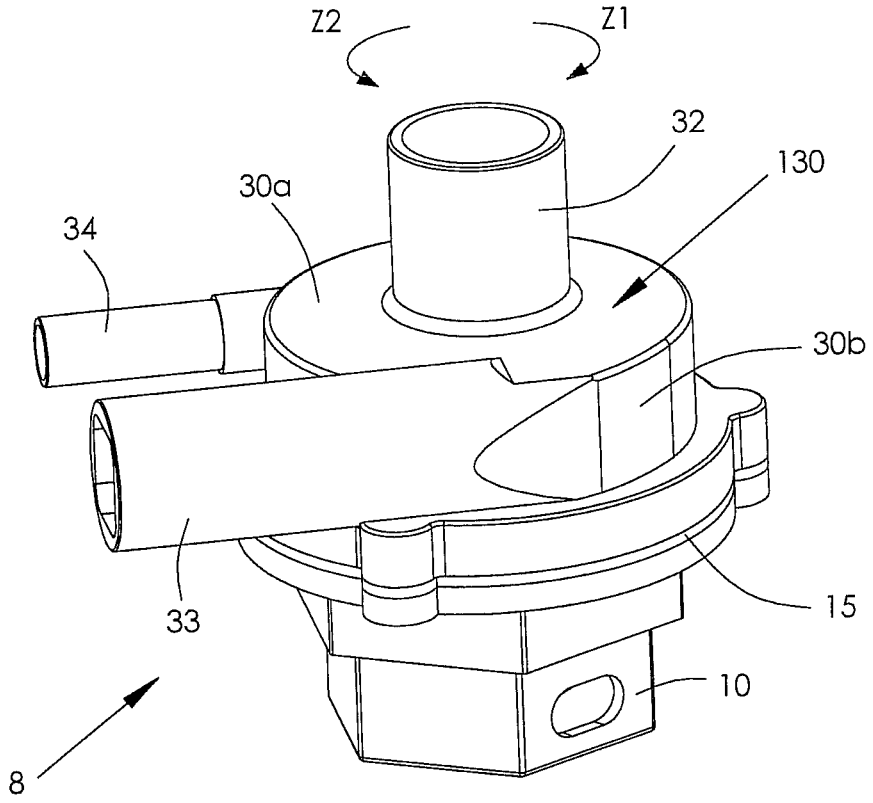
FIG. 1 shows a centrifugal pump in accordance with the preferred embodiment of the present invention.
Figure 2:
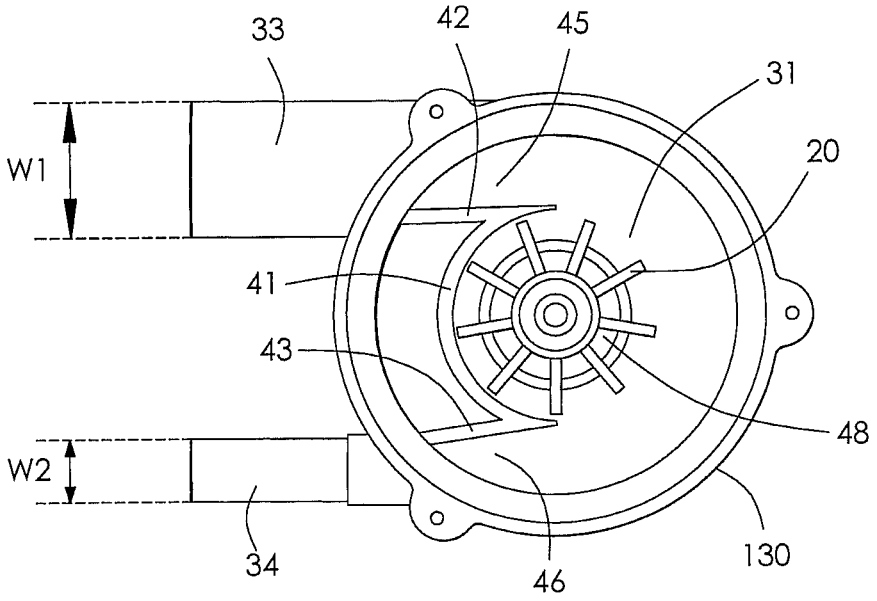
FIG. 2 shows a pump housing and an impeller being a part of the centrifugal pump of FIG. 1.
Figure 3:
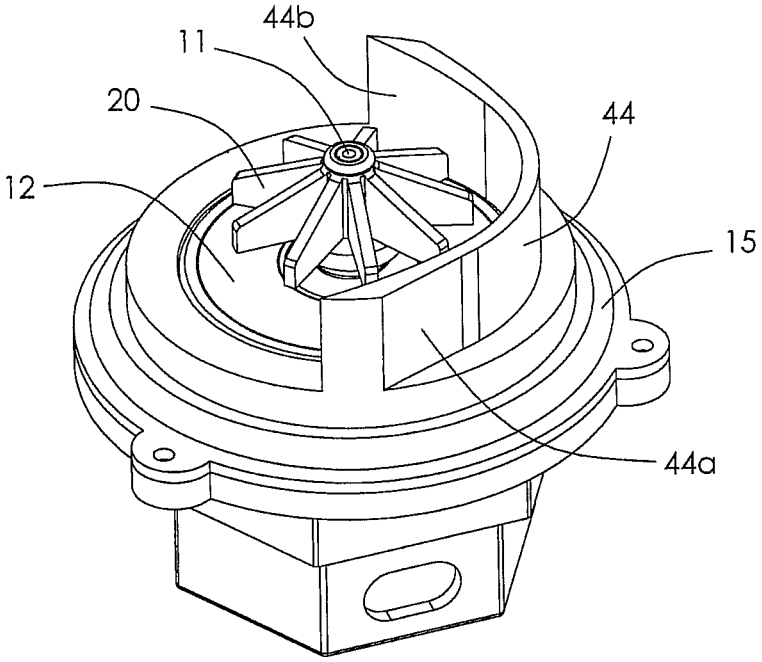
FIG. 3 shows the centrifugal pump of FIG. 1, with the pump housing removed.

As shown in FIGS. 1 to 3, a centrifugal pump 8 according to the preferred embodiment of the present invention comprises an electric motor 10 with an output shaft 11, a base 12, an impeller 20 coupled to the output shaft and a pump housing 130. A seal 15 is arranged between the base 12, the pump housing 130 and the motor 10 to prevent the water from leaking out from the pump. Preferably, the base 12, the impeller 20, the seal 15 and the pump housing 130 are made of plastic. The motor 10 is a BLDC motor.

The pump housing 130 has an impeller chamber 31 in which the impeller 20 is received, an inlet 32, a first outlet 33 and a second outlet 34. The inlet 32 outwardly extends from a top wall 30*a* of the pump housing 130 in an axial direction of the motor 10 and communicates with the impeller chamber 31 via a circular opening 48. The first outlet 33 and the second outlet 34 outwardly extend from a side wall 30*b* of the pump housing 130 and are arranged in parallel at one side of the impeller 20. In this embodiment, the first outlet 33 and the second outlet 34 are in communication with the impeller chamber 31 at all times. The width W1 of the first outlet 33 is greater than the width W2 of the second outlet 34. When the centrifugal pump is applied to a washing machine, the inlet 32 is connected to a tub, the first outlet 33 is connected to a drain pipe, and the second outlet 34 is connected to a circulating pipe to re-circulate the water back to the tub.

An interference structure is arranged in the impeller chamber 31 and comprises first to fourth interference plates 41~44. The first interference plate 41 is arcuate forming a part cylindrical wall extending from the top wall 30*a* to the base 12 and is arranged on the same side of the impeller 20 as the first and second outlets. The first interference plate 41 partially surrounds the impeller 20 and is concentric with the impeller 20. The second interference plate 42 and the third interference plate 43 extend to the side wall 30*b* of the pump housing 130 from two ends of the first interference plate 41. The second interference plate 42 and the side wall 30*b* form a first flow channel 45 in communication with the first outlet 33, and the third interference plate 43 and the side wall 30*b* form a second flow channel 46 in communication with the second outlet 34. The fourth interference plate 44 is disposed on the opposite side of the impeller 20 to the first interference plate 41 and also partially surrounds the impeller 20. Preferably, the fourth interference plate 44 is formed as part of the base 12 and extends axially to the top wall 30*a*. The fourth interference plate 44 has two end portions 44*a* and 44*b* contacting the side wall 30*b*. The end portion 44*a* and the second interference plate 42 form an entrance to the first flow channel 45. The end portion 44*b* and the third interference plate 43 form an entrance to the second flow channel 46. Each of the interference plates 41~44 extends to the top wall 30*a* and the base 12 in the axial direction of the motor 10. The interference plates may be integrally molded with the pump housing 130 or with the base 12. As shown, in the preferred embodiment the first, second and third interference plates are formed with the pump housing and the fourth interference plate is formed with the base.

Figure 4:
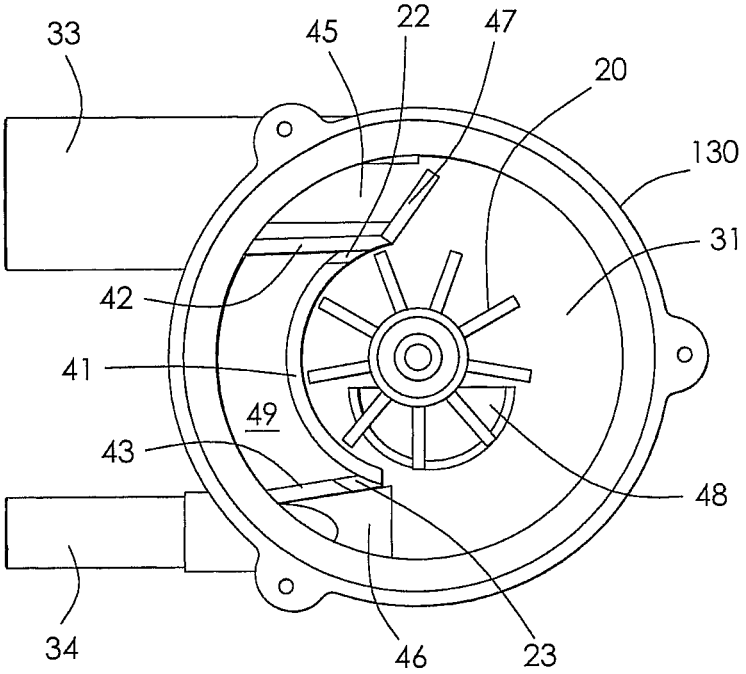
FIG. 4 shows another kind of pump housing of the centrifugal pump of FIG. 1.
Figure 5:
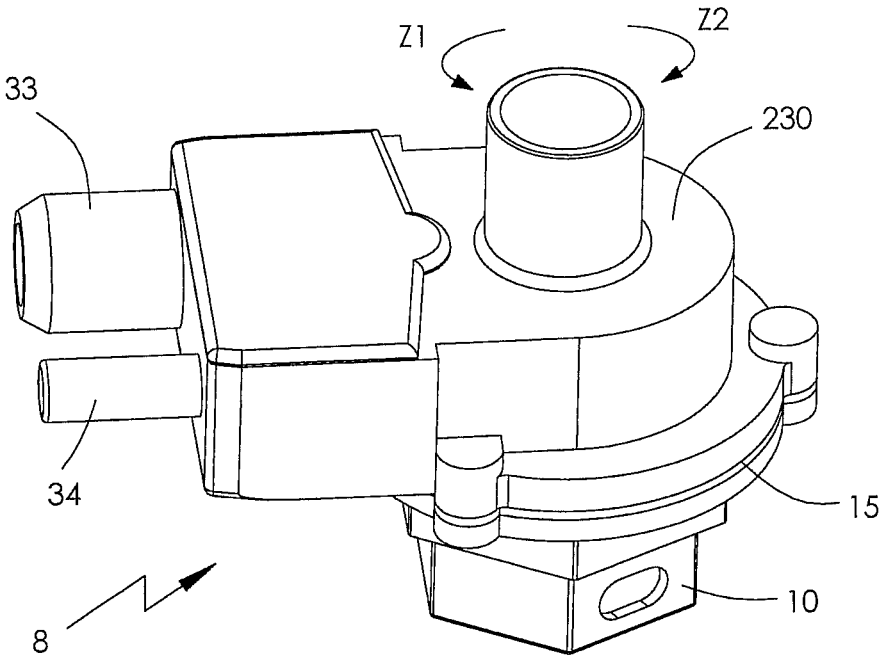
FIG. 5 shows a centrifugal pump in accordance with a second embodiment of the present invention.
Figure 6:
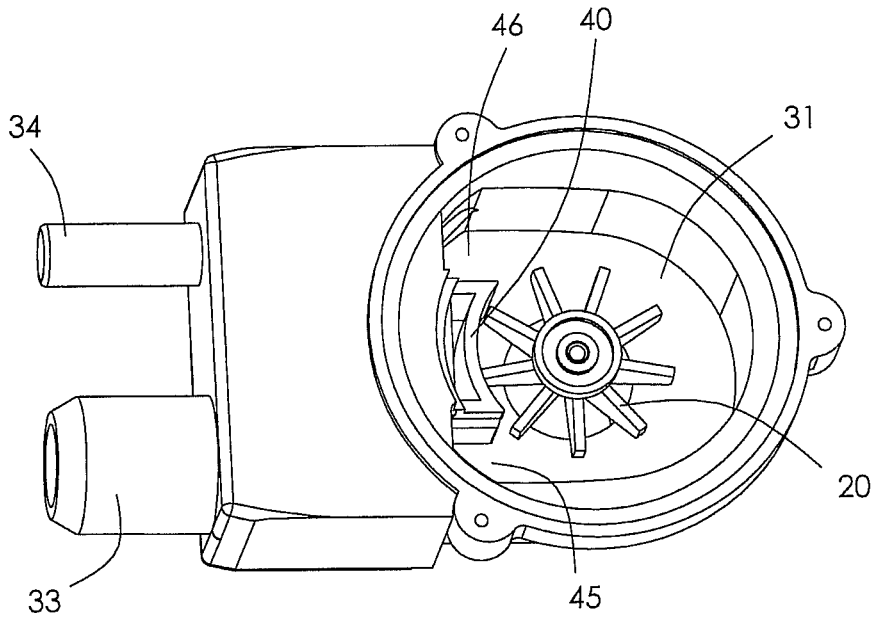
FIG. 6 shows a pump housing and an impeller being a part of the centrifugal pump of FIG. 5.
Figure 7:
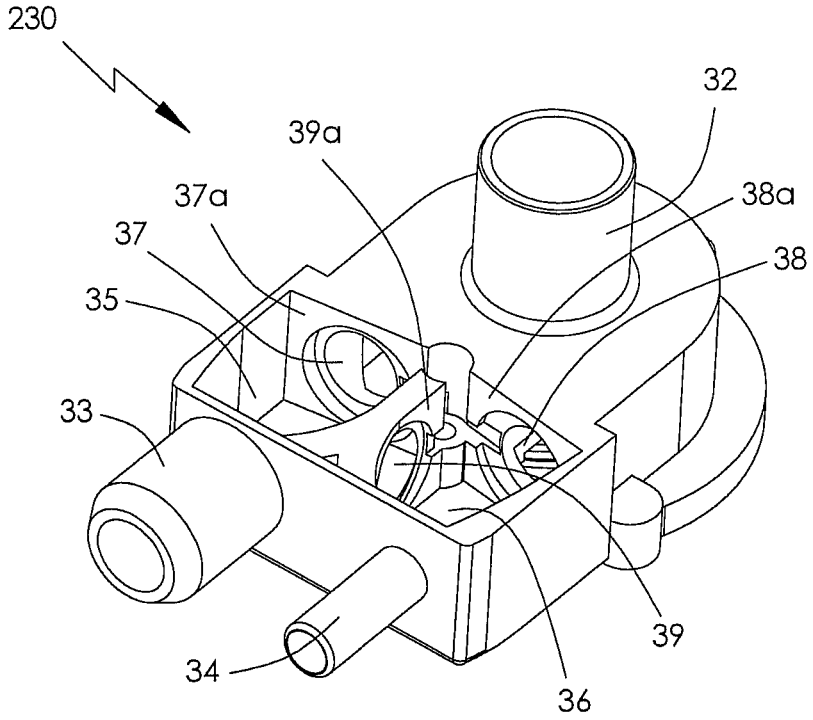
FIG. 7 shows the pump housing of FIG. 6, with a top wall of the pump housing partially removed.

An alternative pump housing 130 is shown in FIG. 4. In this embodiment, the inlet 32 is in communication with the impeller chamber 31 via a semi-circular opening 48, and the minimum distance between the opening 48 and the first interference plate 41 generally increases from the second flow channel 46 to the first flow channel 45. Furthermore, the interference structure also comprises an interference part 47 arranged in the first flow channel 45 for impeding water flow towards the first outlet 33 when the water is required to be pumped through the second outlet 34. The interference part 47 may be at least one projection inwardly extending from the top wall 30*a* or from the base 12. The center of the opening 48 is at one side of the center of the impeller 20 nearer to the second flow channel 46 relative to the first flow channel 45, thereby being nearer to the center of the second flow channel 46 relative to the center of the first flow channel 45. Each of the above configurations helps to compensate the flow ability imbalance between the two outlets 33, 34, which results from the first outlet 33 being wider than the second outlet 34. Moreover, at least one reflux notch or hole 22 communicating the impeller chamber 31 with a chamber 49 formed between the first to the third interference plates 41~43, is formed in one end of the first interference plate 41 near the second interference plate 42, and at least one reflux notch or hole 23 communicating the second flow channel 46 with the chamber 49 is formed in the third interference plate 43. With water flowing back to the impeller chamber 31 via the reflux notches or holes 23 and 22, excessive water pressure in the second flow channel 46 can be avoided. It should be understood that the first interference plate 41 may alternatively be eccentric with the impeller 20, and the opening 48 between the impeller chamber 31 and the inlet 32 is not limited to the semi-circular shape. The interference part 47 may alternatively extend from the second interference plate 42 or from the side wall 30*b*.

The operation of the centrifugal pump 8 will now be described. During the drain operation cycle, the motor 10 rotates the impeller 20 in a direction indicated by the arrow Z1 in FIG. 1. The interference structure directs the water in the impeller chamber 31 to flow out from the first outlet 33 via the first flow channel 45 under the clockwise centrifugal force generated by the impeller 20. During the circulating operation cycle, the motor 10 drives the impeller 20 to rotate in a direction indicated by the arrow Z2 in FIG. 1. The interference structure directs the water in the impeller chamber 31 to flow out from the second outlet 34 via the second flow channel 46 under the centrifugal force generated by the impeller 20.

In the preferred embodiment, no valve is required to control the water in the impeller chamber 31 to flow out from the first outlet 33 or the second outlet 34. This is controlled solely by the direction of rotation of the impeller, so the cost of the pump is low. The first and the fourth interference plates 41 and 44 can limit the water in a small area near the impeller 20, which helps to prevent the water from flowing into the undesired flow channel. Therefore, reliability can be improved and unnecessary loss of water can be avoided.

A centrifugal pump 8 according to a second embodiment of the present invention is shown in FIGS. 5 to 8. The pump housing 230 has a first outlet chamber 35 formed between the first outlet 33 and the impeller chamber 31 and a second outlet chamber 36 formed between the second outlet 34 and the impeller chamber 31. The first outlet chamber 35 is in communication with the first outlet 33 and the second outlet chamber 36 is in communication with the second outlet 34. A partition wall 37*a* with a first opening 37 is arranged between the first outlet chamber 35 and the impeller chamber 31, a partition wall 38*a* with a second opening 38 is arranged between the second outlet chamber 36 and the impeller chamber 31, and a partition wall 39*a* with a third opening 39 is arranged between the first outlet chamber 35 and the second outlet chamber 36. The three openings 37~39 have a similar size and shape. The angle between the first opening 37 and the third opening 39 is equal to the angle between the second opening 38 and the third opening 39.

An interference structure 40 is arranged in the impeller chamber 31. The interference structure 40 and the side wall 30*b* of the pump housing 230 form a first flow channel 45 in communication with the first outlet chamber 33 and a second flow channel 46 in communication with the second outlet chamber 34.

Figure 8:
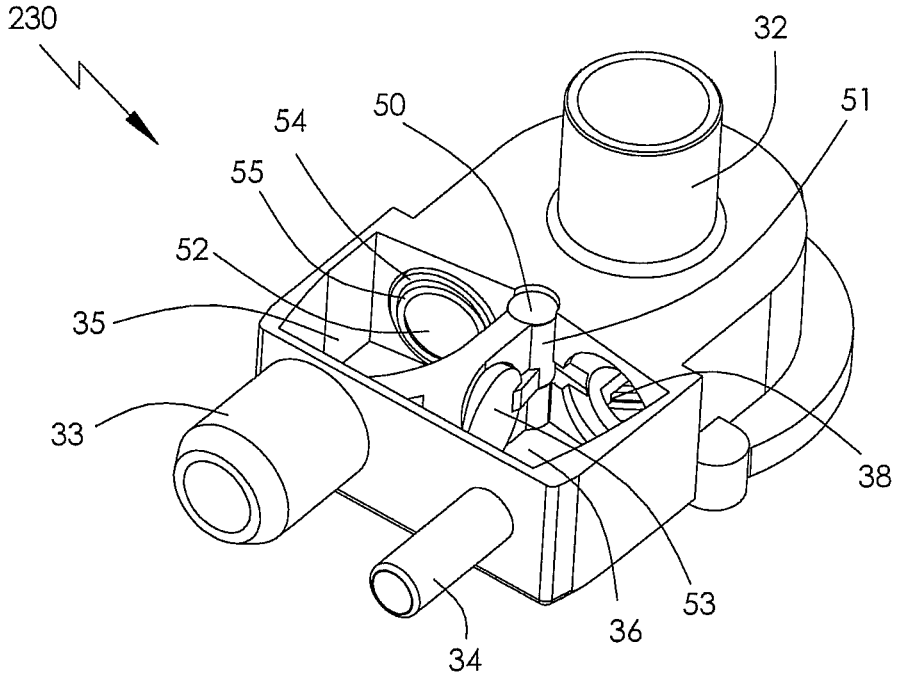
FIG. 8 shows the pump housing and a valve being a part of the centrifugal pump of FIG. 5, with the top wall partially removed.
Figure 8A:
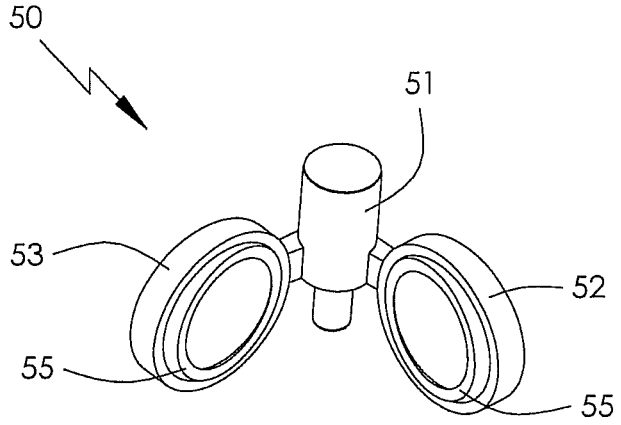
FIG. 8*a* illustrates the value of FIG. 8.

The pump 8 has a valve 50, as shown in FIG. 8*a*, comprising a shaft 51 which is rotatably mounted at the intersection of the three partition walls 37*a*~39*a*, and a first blocking member 52 and a second blocking member 53 which are fixed relative to the shaft 51. Preferably, the shaft 51 is substantially parallel with the output shaft of the motor 10. The two blocking members 52, 53 are respectively arranged in the two outlet chambers 36, 35 and rotate with the shaft 51. The angle between the two blocking members 52, 53 is substantially equal to the angle between the first opening 37 and the third opening 39. Each of the blocking members 52, 53 has a base plate 54 and a resilient or rubber part 55 on one side of the base plate 54. The base plate 54 is larger than each opening 37~39, and the resilient part 55 matches the openings 37~-39 so as to be inserted into the openings to prevent water leakage between the two outlet chambers 35, 36. The resilient parts 55 of the two blocking members 52, 53 are opposite to each other. Preferably, the cross-sectional area of the resilient part 55 gradually decreases along the direction away from the base plate 54 so that the resilient part can be easily inserted into the openings. It should be understood that the blocking members 52, 53 may alternatively have no resilient part or have resilient parts on both sides of the base plate 54. Alternatively, the resilient parts may be formed on the openings, to form a seal between the openings and the blocking members.

Figure 9:
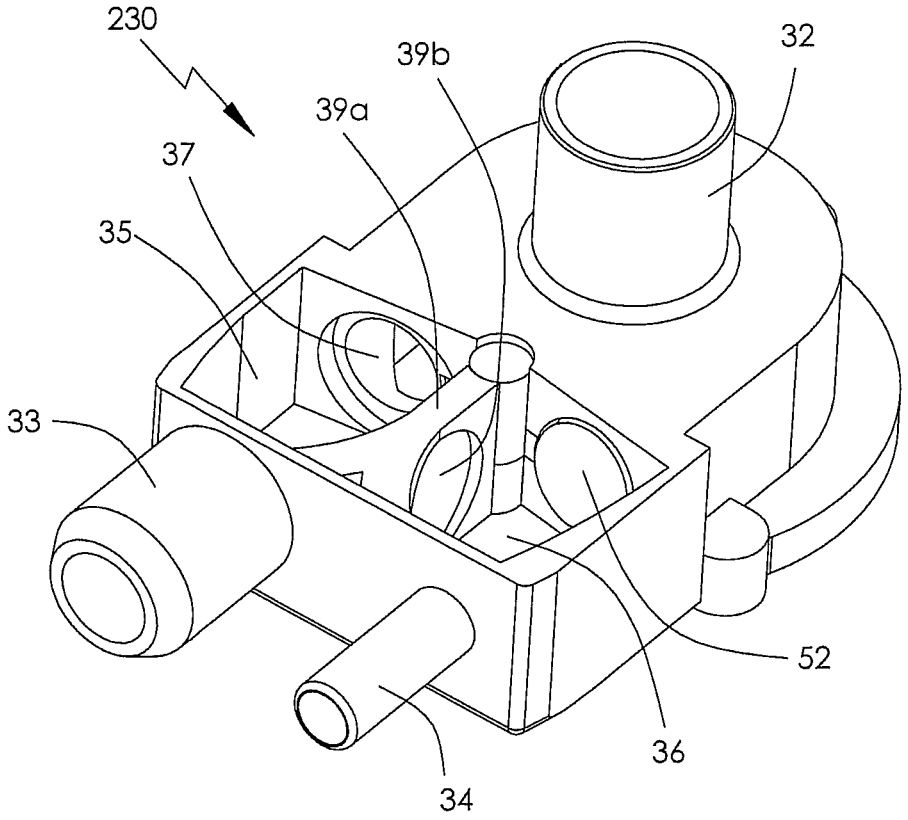
FIG. 9 shows another kind of pump housing of the centrifugal pump of FIG. 5.
Figure 10:
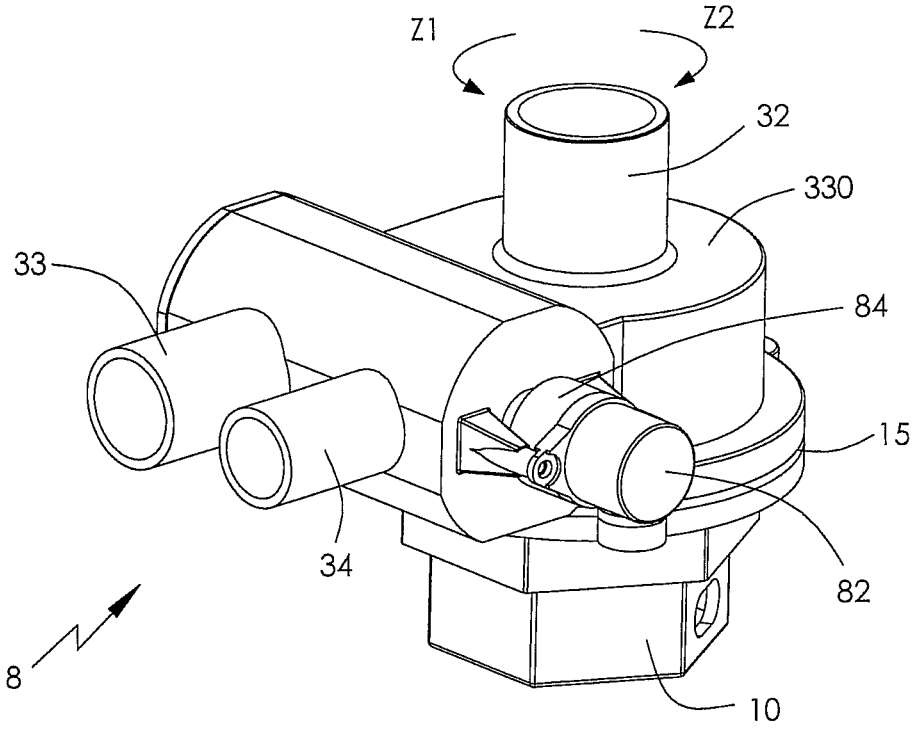
FIG. 10 shows a centrifugal pump in accordance with a third embodiment of the present invention.
Figure 11:
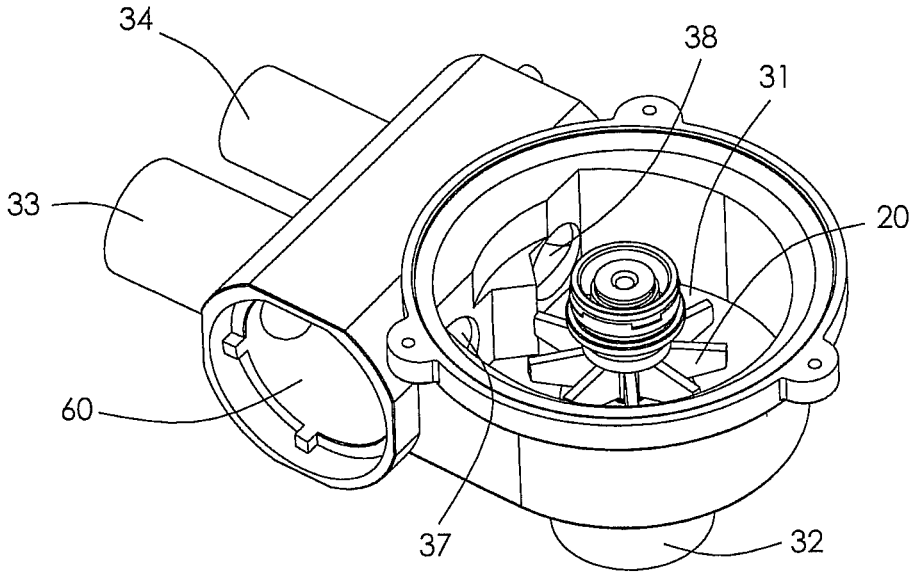
FIG. 11 shows a pump housing and an impeller being a part of the centrifugal pump of FIG. 10, with an end plate of an outlet chamber of the pump housing removed.
Figure 12:
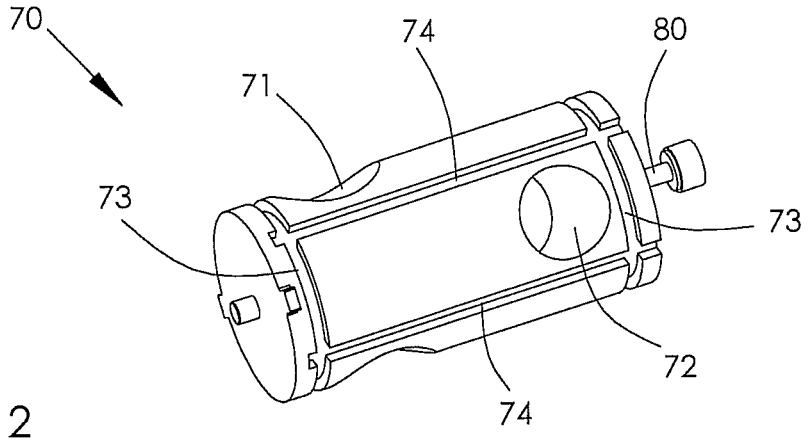
FIG. 12 shows a valve being a part of the centrifugal pump of FIG. 10.
Figure 13:
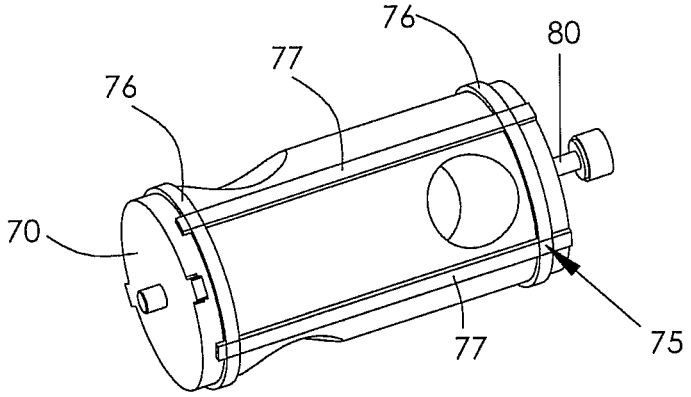
FIG. 13 shows a valve and a sealing member being a part of the centrifugal pump of FIG. 10.

Referring to FIG. 9, in a modified pump housing 230 in accordance with the second embodiment, a partition wall 39*a* without an opening is arranged between the first outlet chamber 35 and the second outlet chamber 36. Two recesses 39*b* for receiving the blocking members 52, 53 are formed in opposite side surfaces of the partition wall 39*a*.

The operation of the centrifugal pump 8 will now be described. During the drain operation cycle, the motor 10 drives the impeller 20 to rotate in a direction indicated by the arrow Z1 in FIG. 5. The water in the impeller chamber 31 flows towards the first outlet chamber 35 via the first flow channel 45 under the centrifugal force generated by the impeller 20 and presses the first blocking member 52 to move towards the third opening 39 until the resilient part 55 of the first blocking member 52 is inserted into the third opening 39. At the same time, the second blocking member 53 fixedly linked to the first blocking member 52 closes the second opening 38. Therefore, the second outlet chamber 36 is isolated from the impeller chamber 31 and the water only flows out from the first outlet 33. During the recirculating operation cycle, the motor 10 drives the impeller 20 to rotate in a direction indicated by the arrow Z2 in FIG. 5. The water in the impeller chamber 31 flows towards the second outlet chamber 36 via the second flow channel 46 under the centrifugal force generated by the impeller 20 and presses the second blocking member 53 to move towards the third opening 39 until the resilient part 55 of the second blocking member 53 is inserted into the third opening 39. At the same time, the first blocking member 52 closes the first opening 37. Therefore the first outlet chamber 35 is isolated from the impeller chamber 31 and the water only flows out from the second outlet 34. In the modified housing of FIG. 9, the blocking members 52, 53, simply open or close the first and second openings 37, 38, as there is no third opening and the two chambers remain isolated from each other at all times.

In the second embodiment, the valve 50 is driven by water pressure, so a controller for the valve 50 is not required. The interference structure 40 is helpful to prevent water from flowing towards both outlets 33, 34 at the same time which will counteract the movement of the blocking members 52, 53.

As shown in FIGS. 10 to 13, in a centrifugal pump 8 in accordance with a third embodiment of the present invention, the pump housing 330 has an outlet chamber 60 formed between the impeller chamber 31 and the first and the second outlets 33, 34. The outlet chamber 60 is in communication with the first outlet 33 and the second outlet 34. A first opening 37 opposite to the first outlet 33 and a second opening 38 opposite to the second outlet 34 are formed between the outlet chamber 60 and the impeller chamber 31.

A valve 70 is rotatably mounted in the outlet chamber 60. The valve 70 may be made of plastic and is fixed to a shaft 80. Preferably, the shaft 80 is an output shaft of a speed reduction gearbox 84 which is driven by a second electric motor 82. The second motor 82 may be a stepper motor or a synchronous motor. The valve 70 is a cylinder extending in an axial direction of the shaft 80. The valve 70 has a first through hole 71 and a second through hole 72 not in communication with the first through hole 71 formed at positions corresponding to the first opening 37 and the second opening 38. By rotating the valve 70, the impeller chamber 31 can be alternately in communication with the first outlet 33 via the first through hole 71 or in communication with the second outlet 34 via the second through hole 72. A resilient sealing member 76 for preventing water leakage between the first outlet 33 and the second outlet 34 is arranged between the valve 70 and the inner surface of the outlet chamber 60. The valve 70 has two annular grooves 73 at the two ends thereof and four axially extending grooves 74 circumferentially distributed between the two through holes 71, 72. The sealing member 76 has two annular parts 76 tightly received into the two annular grooves 73 and four axially extend parts 77 tightly received into the four axially extending grooves 74.

The operation of the centrifugal pump 8 will now be described. During the drain operation cycle, the first motor 10 drives the impeller 20 to rotate in a direction indicated by the arrow Z1 in FIG. 10. The water in the impeller chamber 31 flows towards the first opening 37 under the centrifugal force generated by the impeller 20. The second motor 82 drives the valve 70 to a position that the first through hole 71 aligns with the first opening 37 to connect the first opening with the first outlet 33. In this case, the second through hole 72 completely deviates from the second opening 38 thereby sealing the second opening and isolating the second outlet 34 from the impeller chamber 31 by the valve 70 and the sealing member 75. Therefore, the water only flows out from the first outlet 33. During the circulating operation cycle, the first motor 10 drives the impeller 20 to rotate in a direction indicated by the arrow Z2 in FIG. 10. The water in the impeller chamber 31 flows towards the second opening 38 under the centrifugal force generated by the impeller 20. The second motor 82 drives the valve 70 to a position where the second through hole 72 aligns with the second opening 38 to connect the second opening with the second output 34. In this case, the first through hole 71 completely deviates from the first opening 37 thereby sealing the first opening and isolating the first output 33 from the impeller chamber 31 by the valve 70 and the sealing member 75. Therefore, the water only flows out from the second outlet 34.

Figure 14:
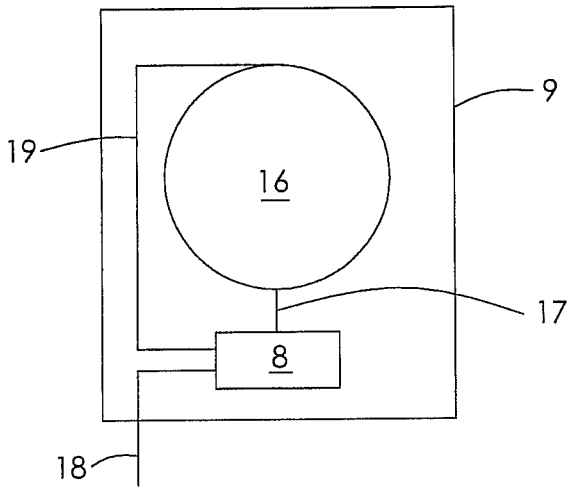
FIG. 14 is a schematic diagram of a domestic appliance using a pump according to the present invention.

FIG. 14 is a schematic diagram showing a domestic appliance 9, in the form of a washing machine, incorporating a pump 8 as described above, whereby the appliance has a tub 16 for water and clothes to be washed, a single pump 8 having an inlet connected to the tub by a transfer hose 17 and two outlets for two different water flow paths such as a drain hose 18 and a circulating hose 19. The choice of the flow path is determined by the direction of rotation of the impeller with or without the use of a single additional valve which may be driven by the water flow or by a separate motor.

In the description and claims of the present application, each of the verbs "comprise", "include", "contain" and "have", and variations thereof, are used in an inclusive sense, to specify the presence of the stated item but not to exclude the presence of additional items.

Although the invention is described with reference to one or more preferred embodiments, it should be appreciated by those skilled in the art that various modifications are possible. Therefore, the scope of the invention is to be determined by reference to the claims that follow.

The invention claimed is:

1. A centrifugal pump comprising: an electric motor, an impeller driven by the motor; and a pump housing, wherein the pump housing has an impeller chamber, an inlet in communication with the impeller chamber via an opening, a first outlet and a second outlet, the first outlet and the second outlet being in communication with the impeller chamber at all times;

an interference structure is arranged within the impeller chamber and forms a first flow channel in communication with the first outlet and a second flow channel in communication with the second outlet; and the interference structure is configured to direct fluid in the impeller chamber to flow through the first outlet via the first flow channel when the impeller rotates in a first direction and to direct fluid in the impeller chamber to flow through the second outlet via the second flow channel when the impeller rotates in a second direction;

wherein the pump housing comprises a top wall and a side wall, the first outlet and the second outlet outwardly extend from the side wall and are arranged at one side of the impeller;

wherein the interference structure comprises a first interference plate which is arranged at the same side of the impeller as the first outlet and the second outlet and partially surrounds the impeller; a second interference plate and a third interference plate which extend to the side wall from respective circumferential ends of the first interference plate, the second interference plate forming the first flow channel with the side wall and the third interference plate forming the second flow channel with the side wall; and a fourth interference plate partially surrounding the impeller at the side of the impeller remote from the first and second outlets; the fourth interference plate has two end portions extending to the side wall, one of the end portions forming an entrance of the first flow channel with the second interference plate and the other one forming an entrance of the second flow channel with the third interference plate.

2. The centrifugal pump of claim 1, wherein the interference structure further comprises another interference plate which is arranged at the same side of the impeller as the first outlet and the second outlet, partially surrounds the impeller, and is concentric with the impeller.

3. The centrifugal pump of claim 1, wherein the first outlet is wider than the second outlet and the interference structure further comprises an interference part formed in the first flow channel for impeding flow of the fluid towards the first outlet when the impeller rotates in the second direction.

4. The centrifugal pump of claim 1, wherein the first outlet is wider than the second outlet, the center of the opening between the inlet and the impeller chamber is nearer to the center of the second flow channel relative to the center of the first flow channel or is arranged at one side of the center of the impeller nearer to the second flow channel relative to the first flow channel.

5. A domestic appliance incorporating the centrifugal pump of claim 1.

6. A centrifugal pump comprising:

an electric motor, an impeller driven by the motor; and a pump housing, wherein the pump housing has an impeller chamber, an inlet in communication with the impeller chamber via an opening, a first outlet and a second outlet, the first outlet and the second outlet being in communication with the impeller chamber at all times;

an interference structure is arranged within the impeller chamber and forms a first flow channel in communication with the first outlet and a second flow channel in communication with the second outlet; and the interference structure is configured to direct fluid in the impeller chamber to flow through the first outlet via the flow channel when the impeller rotates in a first direction and to direct fluid in the impeller chamber to flow through the second outlet via the second flow channel when the impeller rotates in a second direction;

wherein the pump housing comprises a top wall and a side wall, first outlet and the second outlet outwardly extend from the side wall and are arranged at one side of the impeller;

wherein the interference structure comprises a first interference plate which is arranged at the same side of the impeller as the first outlet and the second outlet and partially surrounds the impeller;

wherein the first outlet is wider than the second outlet, the distance between the first interference plate and the opening between the inlet and the impeller chamber gradually increasing from the second flow channel to the first flow channel.

7. The centrifugal pump of claim 6, wherein the interference structure further comprises a second interference plate and a third interference plate which extend to the side wall from respective circumferential ends of the first interference plate, the second interference plate forming the first flow channel with the side wall and the third interference plate forming the second flow channel with the side wall.

8. The centrifugal pump of claim 7, wherein the first interference plate has at least one reflux notch or hole formed at one end near the second interference plate, and the third interference plate has at least one reflux notch or hole formed near the first interference plate.

9. The centrifugal pump of claim 7, wherein the interference structure further comprises a fourth interference plate partially surrounding the impeller at the side of the impeller remote from the first interference plate.

10. The centrifugal pump of claim 9, wherein the fourth interference plate has two end portions extending to the side wall, one of the end portions forming an entrance of the first flow channel with the second interference plate and the other one forming an entrance of the second flow channel with the third interference plate.

11. A centrifugal pump comprising: an electric motor; an impeller driven by the motor; a rotatable valve; and a pump housing, wherein: the pump housing has a top wall and a side wall forming an impeller chamber, an inlet outwardly extending from the top wall in an axial direction of the motor and in communication with the impeller chamber, a first outlet and a second outlet, a first outlet chamber formed between the first outlet and the impeller chamber and a second outlet chamber formed between the second outlet and the impeller chamber;

the first outlet chamber is in communication with the first outlet and the second outlet chamber is in communication with the second outlet;

a first opening is formed between the first output chamber and the impeller chamber and a second opening is formed between the second output chamber and the impeller chamber; and the valve is rotatably driven by fluid pressure to close the second opening when the impeller rotates in a first direction whereby the fluid in the impeller chamber flows through the first outlet via the first opening and the first outlet chamber and to close the first opening when the impeller rotates in a second direction whereby the fluid in the impeller chamber flows through the second outlet via the second opening and the second outlet chamber.

12. The centrifugal pump of claim 11, wherein the valve comprises a first blocking member which is arranged in the first outlet chamber and a second blocking member which is fixedly linked to the first blocking member and is arranged in the second outlet chamber.

13. The centrifugal pump of claim 12, wherein a partition wall with a third opening is arranged between the first outlet chamber and the second chamber, and the first blocking member and the second blocking member are configured to close the third opening and the second opening when the impeller rotates in the first direction and to close the first opening and the third opening when the impeller rotates in the second direction.

14. The centrifugal pump of claim 12, wherein a partition wall without an opening is arranged between the first outlet chamber and the second chamber, and two recesses for receiving the blocking members are formed in respective side of the partition wall.

15. The centrifugal pump of claim 11, wherein the impeller chamber has an interference structure arranged therein which forms a first flow channel in communication with the first outlet chamber and a second flow channel in communication with the second outlet chamber.

16. A centrifugal pump comprising: a first electric motor; an impeller driven by the first electric motor; and a pump housing having an impeller chamber, an inlet, a first outlet and a second outlet; a second electric motor; and a valve driven by the second electric motor to alternately communicate the first outlet and the second outlet with the impeller chamber, the valve having a rotational axis perpendicular to a rotational axis of the impeller.

17. The centrifugal pump of claim 16, wherein the pump housing further comprises: an outlet chamber formed between the impeller chamber and the first and the second outlets, the outlet chamber being in communication with the first and second outlets;

a first opening opposing the first outlet and a second opening opposing the second outlet are formed between the outlet chamber and the impeller chamber; and the valve is rotatably mounted in the outlet chamber and has a first through hole and a second through hole not in communication with the first through hole, formed at positions corresponding to the first opening and the second opening and arranged to selectively connect the first opening with the first outlet and the second opening with the second outlet, such that the impeller chamber is able to be alternatively in communication with the first outlet via the first through hole and in communication with the second outlet via the second through hole.

18. The centrifugal pump of claim 17, wherein a resilient sealing member is arranged between the valve and an inner surface of the outlet chamber for preventing fluid leakage between the first outlet and the second outlet.

* * * * *